United States Patent [19]

Miyano et al.

[11] Patent Number: 4,539,789

[45] Date of Patent: Sep. 10, 1985

[54] BUNDLING APPARATUS

[75] Inventors: Toshiyuki Miyano, Yokohama; Hideo Ohmura, Tokyo, both of Japan

[73] Assignee: Tokyo Shibaura Denki Kabushiki Kaisha, Japan

[21] Appl. No.: 493,276

[22] Filed: May 10, 1983

[30] Foreign Application Priority Data

May 13, 1982 [JP] Japan ..... 57-80968

[51] Int. Cl.[3] ..... B65B 61/00

[52] U.S. Cl. ..... 53/131; 53/376; 53/588; 100/33 PB

[58] Field of Search ..... 53/131, 586, 587, 588, 53/589; 100/33 PB, 29, 30

[56] References Cited

U.S. PATENT DOCUMENTS 1,235,312 7/1917 Hadert ..... 53/588 X
3,884,015 5/1975 Melton ..... 53/376 X
4,111,116 9/1978 Ito et al. .
4,117,650 10/1978 Ito et al. ..... 53/588 X
4,155,213 5/1979 Blanton et al. ..... 53/587
4,363,692 12/1982 Imamura et al. ..... 53/586 X

FOREIGN PATENT DOCUMENTS 2078207 1/1982 United Kingdom .

*Primary Examiner*—Paul A. Bell
*Attorney, Agent, or Firm*—Cushman, Darby & Cushman

[57] ABSTRACT

In a bundling apparatus, a main clamping mechanism presses a stack of paper sheets in the direction of thickness of the stack and holds the stack. A band is wound by a winder around the stack of paper sheets held by the main clamping mechanism. The end portions of the band wound around the stack of paper sheets are bonded by a heat-bonding mechanism. Specified data is stamped on the band wound around the stack by a data-stamping mechanism which includes a stamp bearing the specified data and a drive mechanism for bringing the stamp into contact with the band while the end portions of the band are being bonded to each other.

9 Claims, 19 Drawing Figures

BUNDLING APPARATUS

BACKGROUND OF THE INVENTION

This invention relates to an apparatus for bundling objects stacked in a pile, and more particularly to a bundling apparatus in which objects to be bundled are pressed by a clamping means, a band is wound around the stack of objects and the end portions of the band are superposed and bonded together, thus bundling the objects.

A conventional bundling apparatus of this type has a bundler which includes a pair of endless belts facing each other. In operation, objects, e.g., sheets stacked in a pile, are fed and held with pressure between the endless belts. As the bundler rotates, a thermal adhesive tape (coated on one side with a thermally fusible material) is supplied from a reel and wound around the stack of sheets. The tape is cut, and the end portions of the tape wound about the stack are superposed and bonded together with heat and pressure by a heater block, thereby bundling the sheets.

Various data, such as the date of bundling, the name of the checker or the classification of the sheets (e.g., the denomination if the sheets are bank notes), must be stamped on the thermal adhesive tape. As a matter of course, the data cannot be stamped until the end portions of the tape are bonded together. In other words, they cannot be stamped at the same time that the end portions of the tape are bonded together. For this reason, the efficiency of the combined operation of bundling the sheets and stamping the data cannot be enhanced.

SUMMARY OF THE INVENTION

Accordingly, the object of the present invention is to provide a bundling apparatus which can stamp data on a band wound around a stack of objects while the end portions of the band are being adhered to each other and which can thus enhance the efficiency of the combined operation of bundling the objects and stamping the data.

According to an aspect of the invention, there is provided a bundling apparatus which comprises first clamping means for pressing a stack of objects in the direction of the thickness of the stack and holding the stack, band-winding means for winding a band around the stack of objects held by the first clamping means, bonding means for bonding the end portions of the band wound around the stack to each other, and data-stamping means for stamping specified data on the band wound around the stack of objects. The data-stamping means includes a stamp bearing the specified data and first drive means for bringing the stamp into contact with the band while the end portions of the band are being bonded to each other.

DETAILED DESCRIPTION OF THE PREFERRED EMBODIMENT

A bundling apparatus according to one embodiment of the present invention will now be described in detail with reference to the accompanying drawings.

The bundling apparatus serves to bundle objects to be bundled, e.g., a stack of bank notes, and mainly comprises a transfer mechanism 1 and a bundling mechanism 2.

Figure 1A:
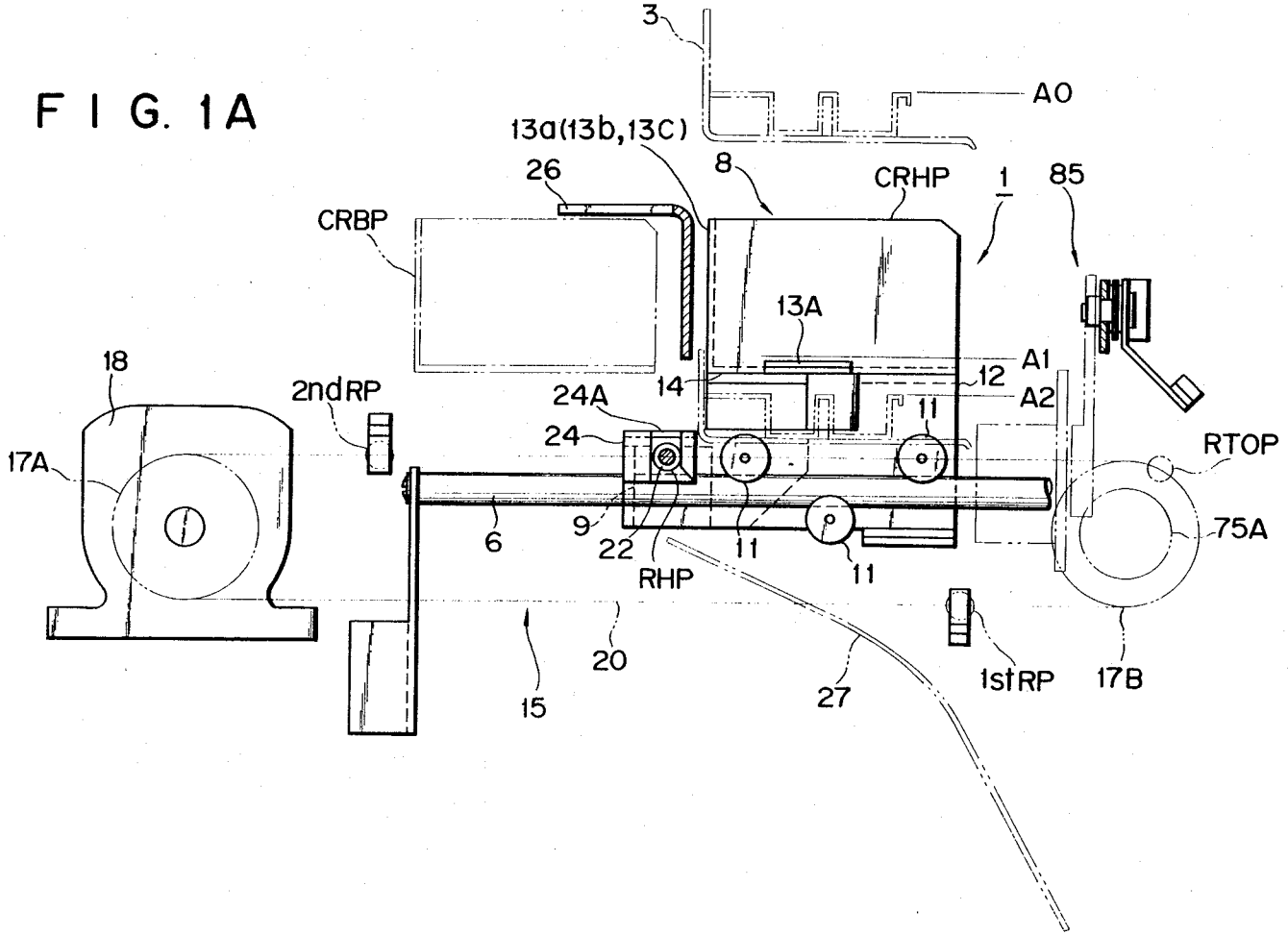
FIG. 1A is a front view of a transfer mechanism of a bundling apparatus according to one embodiment of the present invention.
Figure 1B:
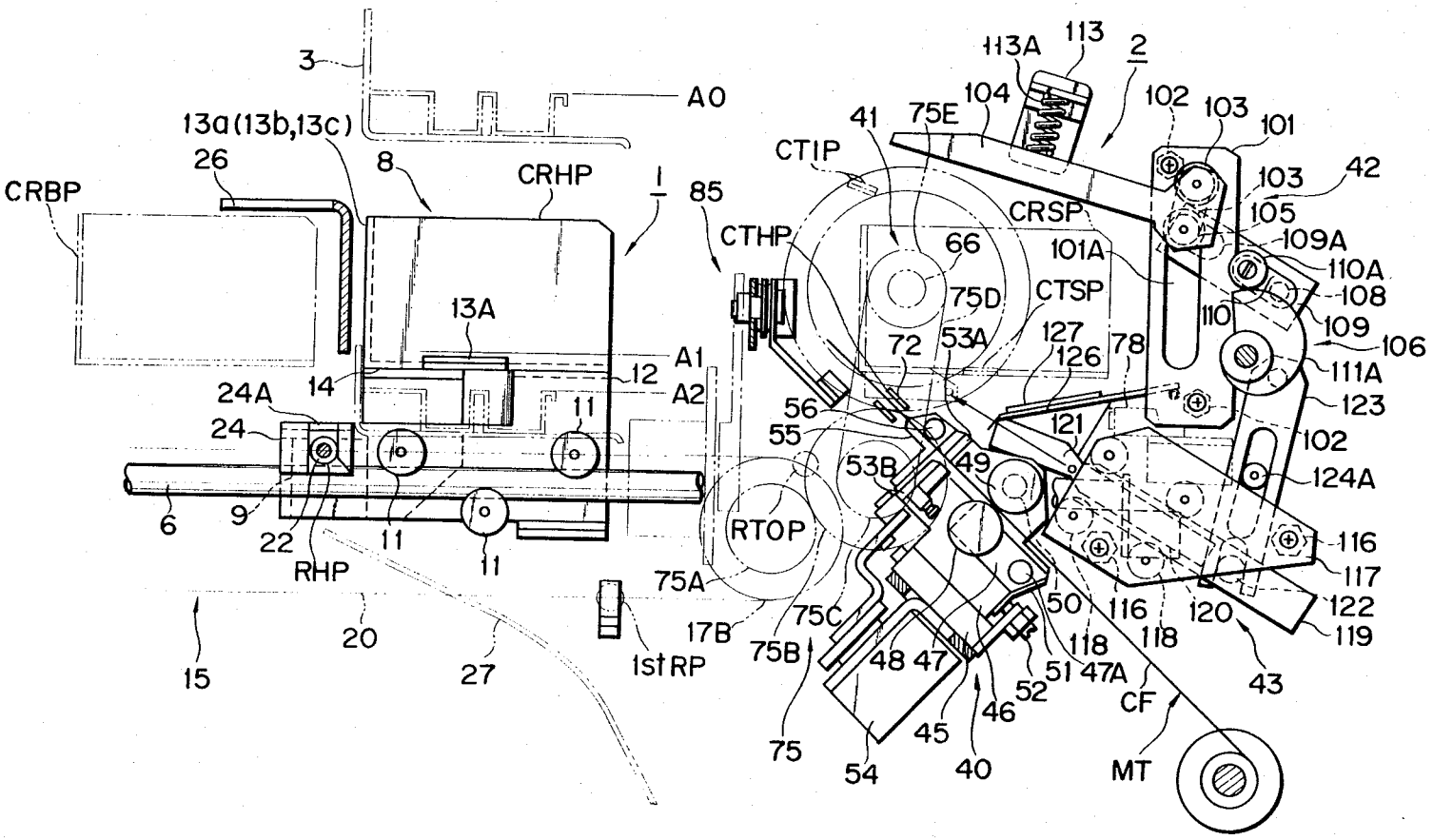
FIG. 1B is a front view of a bundling mechanism of the bundling apparatus.

In FIGS. 1A and 1B, numeral 3 designates a backup plate which carries thereon and vertically transfers a specified number of bank notes stacked by a stacking apparatus (not shown). The transfer mechanism 1 receives the bank notes which are lowered on the backup plate 3 as the backup plate 3 descends and then delivers them to the bundling mechanism 2.

Figure 2:
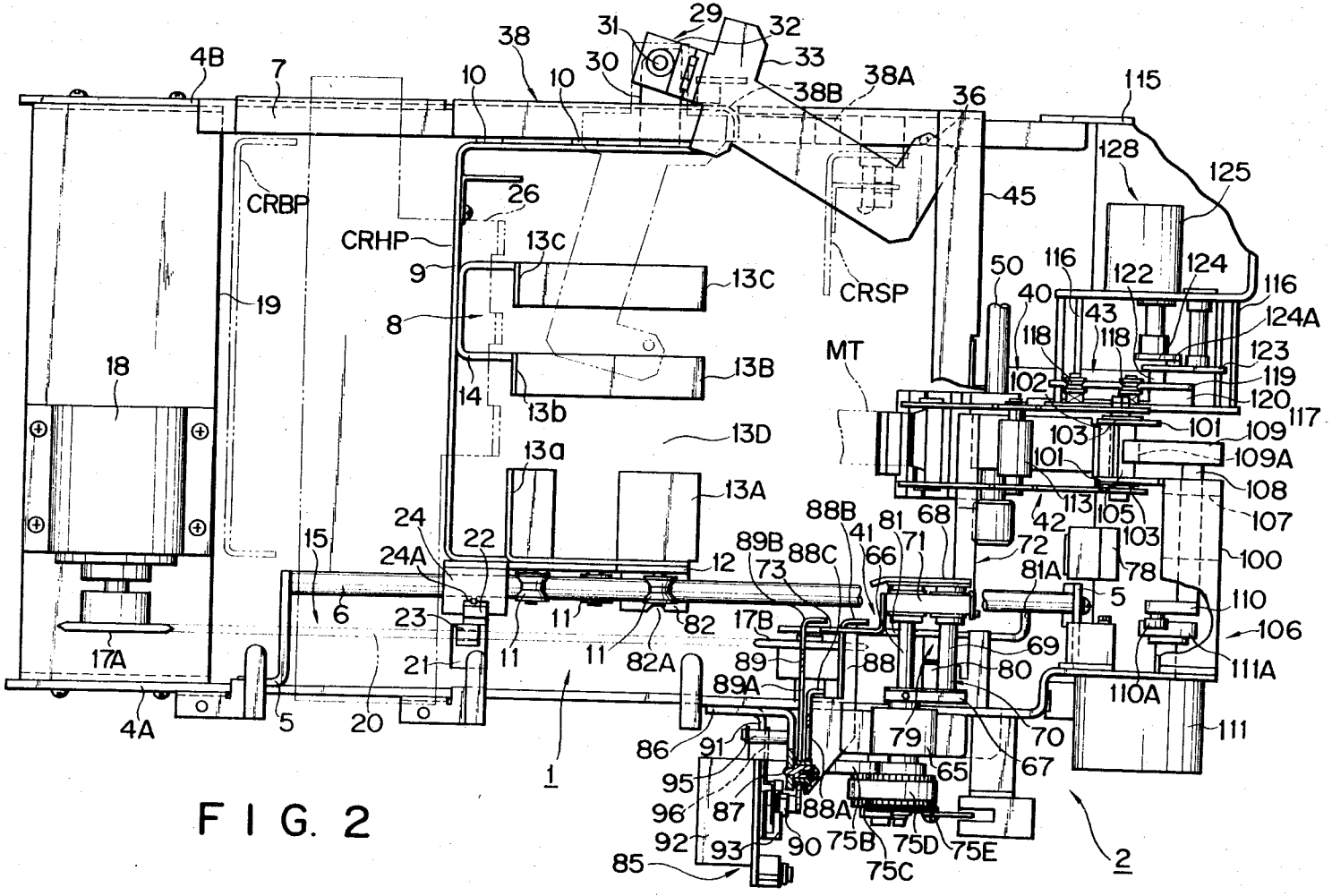
FIG. 2 is a plan view of the bundling apparatus.
Figure 3:
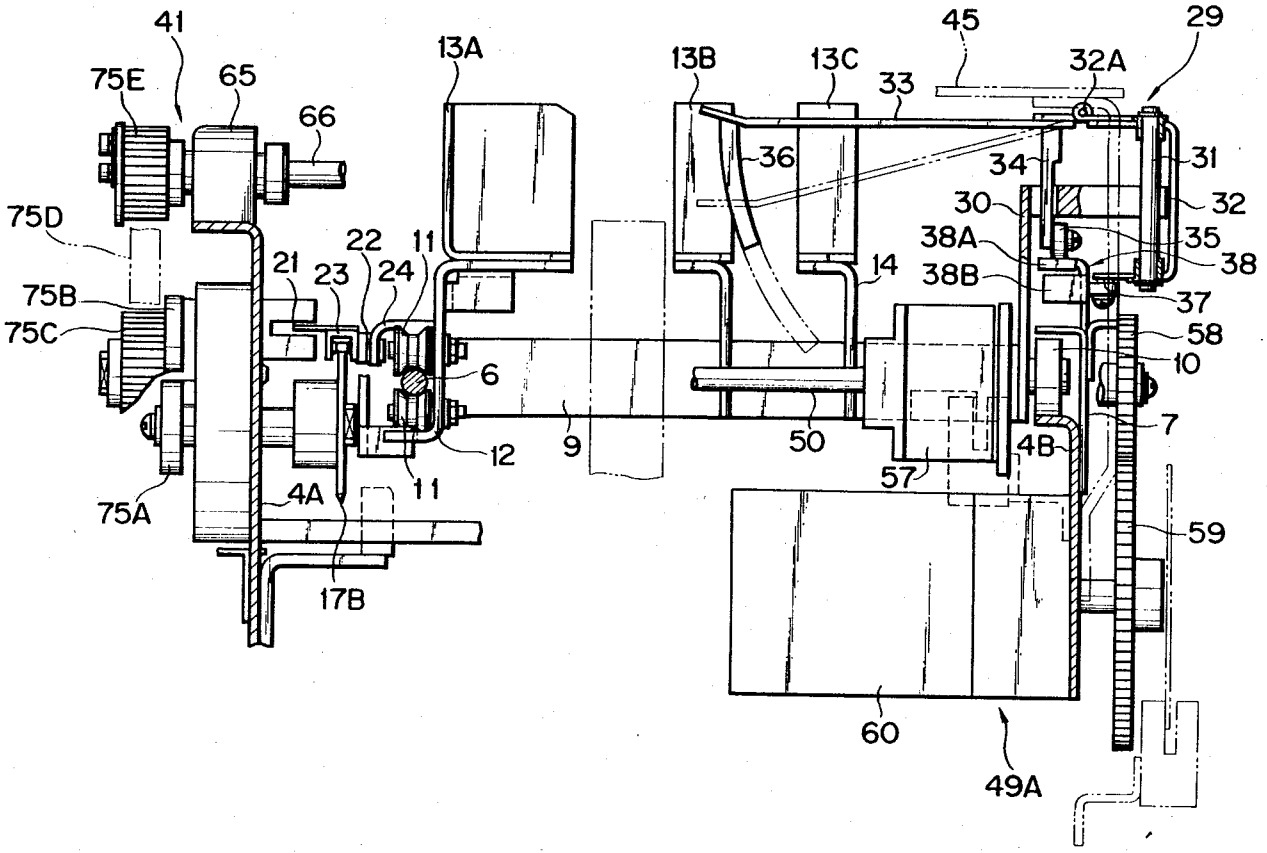
FIG. 3 is a right side view of the bundling apparatus.

The construction of the transfer mechanism 1 will first be explained. As shown in FIGS. 2 and 3, the bundling apparatus comprises a pair of side frames 4A and 4B standing on a base (not shown). The transfer mechanism 1 is attached to these side frames 4A and 4B. A guide rod 6 extends parallel to the one side frame 4A, and is supported at both ends by brackets 5 (FIG. 2) attached to the lateral side of the one side frame 4A. A guide rail 7 is attached to the other side frame 4B, facing the guide rod 6. A carrier 8 is provided between the guide rail 7 and the guide rod 6 so as to be movable along them.

The carrier 8 includes a frame 9 which is substantially U-shaped in a two-dimensional configuration. A plurality of guide rollers 10 in rolling contact with the guide rail 7 are rotatably attached to one lateral portion of the frame 9. Attached to the other lateral portion of the frame 9 is a side bracket 12 with pinch rollers 11 to hold the guide rod 6 from both upper and lower sides. The side bracket 12 is fitted with a first bed 13A having a cut portion and extending horizontally. Second and third beds 13B and 13C are attached to the basal part of the frame 9 by means of an intermediate bracket 14. The second and third beds 13B and 13C are flush with and spaced apart from the first bed 13A. The space between the first and second beds 13A and 13B, which is greater than the width of a band (to be mentioned later), forms a gap portion 13D located in the position where the band is wound by a catcher 72 (to be mentioned later). The beds 13A to 13C of the carrier 8 and the backup plate 3 are nested into each other. Accordingly, the backup plate 3 can descend from an upper position $A_0$ to a lower position $A_2$ below the beds 13A to 13C via an intermediate position $A_1$ substantially flush with the beds 13A to 13C, as shown in FIGS. 1A and 1B.

A carrier driver 15 is provided to move the carrier 8 along the guide rod 6. The carrier driver 15 has a stay 19 which is fixed to the side frames 4A and 4B at both ends. The stay 19 is fitted with a reversible motor 18 having a drive sprocket 17A. The drive sprocket 17A faces one end of the one side frame 4A. An idle sprocket 17B is rotatably attached to the other end of the one side frame 4A. An endless chain 20 is stretched between the two sprockets 17A and 17B. A detecting piece 21 and an engaging roller 22 are attached by means of a link holder 23 to one of links (not shown) constituting the chain 20. The side bracket 12 of the carrier 8 is fitted with a transmission member 24 having a cut portion 24A in which the engaging roller 22 is fitted. The carrier 8 constructed in this manner can move in the longitudinal direction following the movement of the chain 20 through the medium of the engaging roller 22 and the transmission member 24.

With this arrangement, as the backup plate 3 descends, the carrier 8 receives the bank notes from the backup plate 3 in a carrier home position CRHP, indicated by a solid line in FIGS. 1A, 1B and 2. After receiving the bank notes, the carrier 8 is transferred by the carrier driver 15 to a carrier stop position CRSP indicated by a one dot and dashed line in FIGS. 1A, 1B and 2, where the bank notes are bundled by the bundling mechanism 2. Thereafter, as the motor 18 is reversed, the carrier 8 is moved back to a carrier back position CRBP indicated by a two-dots and dashed line in FIGS. 1A, 1B and 2. Then, the motor 18 is rotated in the forward direction, so that the carrier 8 is returned to the carrier home position CRHP. Thus, one cycle of movement for the carrier 8 is completed.

Between the carrier home position CRHP and the carrier back position CRBP, a scraper 26 is attached to the base (not shown). The scraper 26 is nested with the beds 13A to 13C of the carrier 8, and abuts against a bundle of the bank notes (hereinafter referred to simply as a bundle) on the carrier 8. Accordingly, while the carrier 8 is moving from the carrier stop position CRSP to the carrier back position CRBP, the bundle on the carrier 8 engages the scraper 26 to be prevented from moving, and then drops from the carrier 8. Thus, the bundle can be delivered to some subsequent process (not described) by way of a chute 27 under the scraper 26. The use of the scraper 26 enables the bundle to be removed securely from the carrier 8 by a very simple structure.

The carrier 8 is further provided with an auxiliary clamp mechanism 29 for preventing the stack of bank notes on the beds 13A to 13C from collapsing during transfer. The auxiliary clamp mechanism 29 also serves to orient the bank notes delivered from the backup plate 3 onto the carrier 8 in the longitudinal direction (i.e., the bank notes are laid on the carrier 8 so that their longitudinal direction is at right angles to the moving direction of the carrier 8). As shown in FIGS. 2 and 3, one end portion of a clamp bracket 30 is attached to the frame 9 of the carrier 8. A rod 31 is vertically passed through the other end portion of the clamp bracket 30. A clamp holder 32 with a substantially U-shaped cross section is pivotally mounted on the rod 31 so as to be rockable around the rod 31. A clamp plate 33 lies over the clamp holder 32 and is swingable around a hinge 32A within a vertical plane. A first cam follower 35 rotatable on a horizontal axis is attached to the proximal end portion of the clamp plate 33 by means of a stud 34. A curved aligning rod 36 is attached to the distal end portion of the clamp plate 33. When the clamp holder 32 is rocked in the clockwise direction of FIG. 2, the aligning rod 36 is located between the second and third beds 13B and 13C so as not be in contact therewith.

A second cam follower 37 rotatable on a vertical axis is attached to the lower end portion of the clamp holder 32. Fixed on the other side frame 4B is a fixed cam block 38 which engages the first and second cam followers 35 and 37. The fixed cam block 38 is formed of an L-shaped channel bar, comprising a first cam face 38A at the upper surface portion (FIG. 3) to allow for the vertical swinging of the clamp plate 33 and a second cam face 38B at the lateral face portion (FIG. 3) for the horizontal rocking of the clamp holder 32. The right end portion (FIG. 2) of the first cam face 38A is rounded and bent downward and the remaining portion thereof is straight. Therefore, when the first cam follower 35 reaches the right end portion of the first cam face 38A, it comes down to cause the clamp plate 33 to swing counterclockwise (FIG. 3) around the hinge 32A. The right end portion (FIG. 2) of the second cam face 28B is rounded and bent inward and the remaining portion thereof is straight. Therefore, when the second cam follower 37 reaches the right end portion of the second cam face 38B, it moves inward to cause the clamp holder 32 to rock clockwise (FIG. 2) around the rod 31. The right end portion of the first cam face 38A is located on the right (FIG. 2) of the right end portion of the second cam face 38B. The clamp holder 32 is urged to rock clockwise (FIG. 2) by an urging member (not shown).

In such a state that the carrier 8 is located between the carrier home position CRHP and the carrier back position CRBP, the second cam follower 37 is pushed by the straight portion of the second cam face 38B, so that the clamp plate 33 is located in the position indicated by the solid line in FIG. 2. In other words, the clamp plate 33 is removed from the region over the first to third beds, 13A to 13C. In this state the first cam follower 35 lies on the straight portion of the first cam face 38A, so that the clamp plate 33 is kept substantially horizontal, as indicated by the solid line in FIG. 3. In other words, the clamp plate 33 is held above the stack of bank notes laid on the first to third beds 13A to 13C. As the carrier 8 is moved gradually from the carrier home position CRHP to the carrier stop position CRSP of FIG. 2, the second cam follower 37 is disengaged from the second cam face 38B and then the first cam follower 35 is disengaged from the first cam face 38A, at the right end portions thereof, so that the clamp plate 33 gradually swings clockwise (FIG. 3) around the rod 31, urged by the urging member (not shown); thereafter, the clamp plate 33 gradually swings counterclockwise (FIG. 3) around the hinge 32A. Thus, the aligning rod 36 at the distal end of the clamp plate 33 engages the longitudinal edges of the bank notes on the beds 13A to 13C, and pushes the bank notes to back portions **13*a* to 13*c* of the beds 13A to 13C to align or true up the bank notes. After this alignment, the distal end portion of the clamp plate 33 presses on the top of the stack of bank notes trued up by the aligning rod 36**, thereby preventing the stack of bank notes from collapsing during the transfer.

The auxiliary clamp mechanism 29 has an aligning function. Accordingly, no trouble will be caused if the carrier 8 in the carrier home position CRHP is subject to errors in location so that the position of the stack of bank notes on the carrier 8 is deviated. Even though the bank notes on the beds 13A to 13C vary in width, moreover, it is unnecessary to change the carrier home position CRHP and the position of the stacking device including the backup plate 3. Thus, the apparatus of the present invention can enjoy improved applicability to bank notes of varied widths. Since the bank notes are aligned during the transfer of the carrier 8, the processing speed of the apparatus may be increased.

Now the construction of the bundling mechanism 2 will be explained. The bundling mechanism 2 comprises a feeder 40 for supplying a band material coated on one side with a thermally fusible material, e.g., a thermal adhesive tape MT with a coating layer CF on the lower surface as in FIG. 1B, a winder 41 for winding the thermal adhesive tape MT from the feeder 40 around the stack of bank notes delivered thereto by the carrier 8, a main clamp mechanism 42 for compressing and holding the stack of bank notes wound with the thermal adhesive tape MT by the winder 41, and a heat bonding mechanism 43 for thermally bonding the thermal adhesive tape MT around the stack of bank notes. The winder 41 includes a turning mechanism 41A for turning up one end portion of the wound tape MT.

A stay 45 is stretched between the two side frames 4A and 4B in the vicinity of the carrier stop position CRSP. The feeder 40 is attached to the substantially central portion of the stay 45 so that it may be located in the gap portion 13D between the first and second beds 13A and 13B when the carrier 8 is positioned as shown in FIG. 2. As shown in FIG. 1B, a feeder bracket 46 is attached to the stay 45. One end portion of a pinch roller holder 47 is pivotally mounted on the feeder bracket 46 so that the pinch roller holder 47 can rock around a shaft 47A. A pinch roller 48 is rotatably supported on the other end portion of the pinch roller holder 47. A feed roller 49 is mounted on a drive shaft 50 so as to be in contact with the pinch roller 48. An urging member, e.g., a leaf spring 51, is attached to the one end portion of the pinch roller holder 47. The distal end portion of the leaf spring 51 engages the tip portion of an adjust screw 52 attached to the feeder bracket 46. The contact pressure of the pinch roller 48 on the feed roller 49 may be finely adjusted by turning the adjust screw 52. The thermal adhesive tape MT is held between the pinch roller 48 and the feed roller 49, and is fed as the feed roller 49 rotates in the clockwise direction of FIG. 1B and returned as the feed roller 49 rotates in the counterclockwise direction.

On the down-stream side of a tip portion between the feed roller 49 and the pinch roller 48, with respect to the feeding direction of the thermal adhesive tape MT, lie a fixed cutting edge 53A and a movable cutting edge 53B which reciprocates along the fixed cutting edge 53A in accordance with the operation of a rotary solenoid 54. A guide plate 55 and a guide roller 56 for guiding the thermal adhesive tape MT are arranged on the downstream side of the cutting edges 53A and 53B.

As shown in FIG. 3, a drive mechanism 49A for the feed roller 49 comprises an electromagnetic clutch/brake 57 attached to the middle portion of the drive shaft 50, an idle gear 58 mounted on the other end portion of the drive shaft 50, a drive gear 59 in mesh with the idle gear 58, and a feed motor 60 for rotating the drive gear 59. The feed motor 60 is a reversible motor, and it is reversed after the thermal adhesive tape MT is moved around the bank notes by the winder 41. The wound thermal adhesive tape MT is supported in the middle by the guide roller 56, and so is pulled back as the feed roller 49 rotates in the counterclockwise direction of FIG. 2. Thus, the bank notes are bound tight.

Now the construction of the winder 41 will be described. As shown in FIG. 2, a bearing block 65 containing therein a radial bearing (not shown) and other members is attached to the one side frame 4A in the vicinity of the carrier stop position CRSP. A drive shaft 66 is rotatably fitted in the bearing block 65 to be supported thereby. A stop collar 67 and a stop plate 68 are attached, respectively, to the proximal part and the distal end part of that portion of the drive shaft 66 which projects inside the one side frame 4A. The stop collar 67 and the stop plate 68 can rotate together with the drive shaft 66. Between the stop collar 67 and the stop plate 68, a guide shaft 69 extends parallel to the drive shaft 66. The drive shaft 66 and the guide shaft 69 constitute a narrow guide 70. A sliding block 71 is fitted in the narrow guide 70 so as to be slidable along the shafts 66 and 69 between the stop collar 67 and the stop plate 68. The stroke of the sliding block 71 is longer than the width of the thermal adhesive tape MT. The sliding block 71 is provided with a catcher 72 to hold the thermal adhesive tape MT supplied from the feeder 40.

Figure 4A:
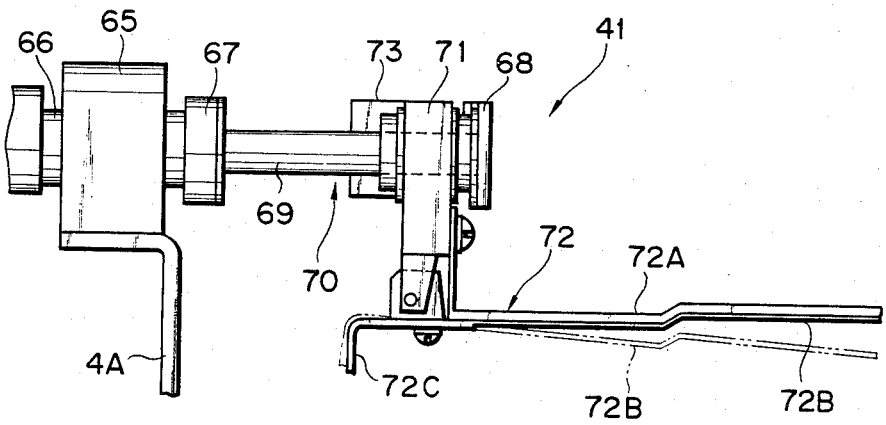
FIG. 4A is a right side view of a winder of the bundling mechanism shown in FIG. 1B.
Figure 5:
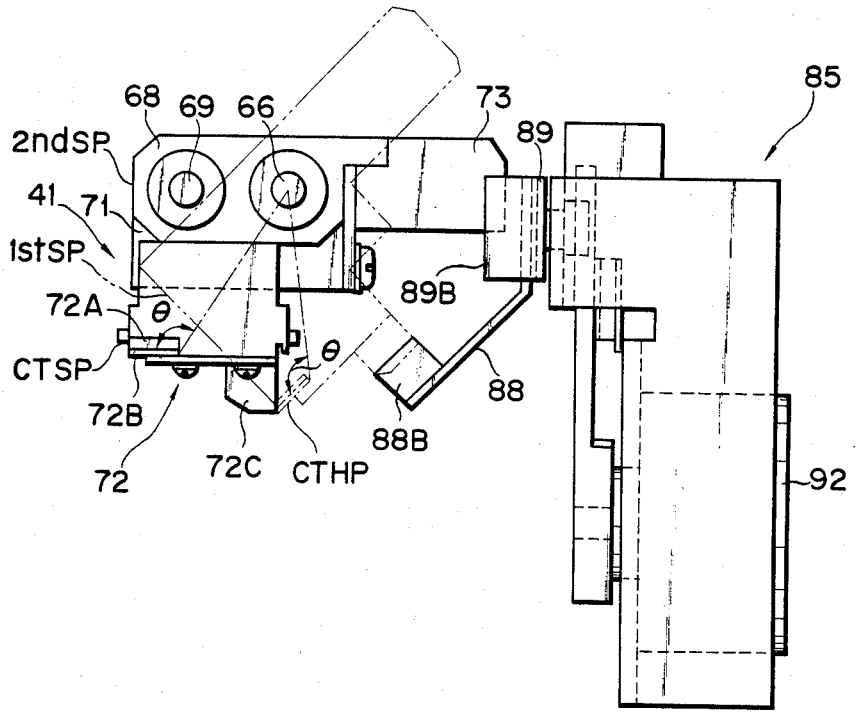
FIG. 5 is a rear view of the winder shown in FIG. 4A.

FIGS. 4A and 5 show the catcher 72 in detail. The catcher 72 includes a platelike fixed catcher member 72A screwed to the sliding block 71, and a platelike swinging catcher member 72B swingably attached to the sliding block 71 and capable of being joined with the fixed catcher member 72A. An L-shaped rocking hook portion 72C is formed at the proximal end portion of the swinging catcher member 72B. By pulling the rocking hook portion 72C to the left of FIG. 4A, the swinging catcher member 72B is separated from the fixed catcher member 72A at a given angle. As shown in FIG. 5, a hook lever 73 is attached to that portion of the sliding block 71 which forms an angle of approximately 90° around the drive shaft 66 with the rocking hook portion 72C. When the hook lever 73 is pulled to the left of FIG. 4A, the sliding block 71 is moved to the left, so that the catcher 72 is taken out of the range of travel of the thermal adhesive tape MT. Namely, the catcher 72 is disengaged from the thermal adhesive tape MT. The hook lever 73, along with the catcher 72 and the hook portion 72C, can revolve around the drive shaft 66 as the shaft 66 rotates, while keeping the relative positions shown in FIG. 5. Here a fixed angle $\theta$ is kept between a plane including the drive shaft 66 and the catcher 72, and an extending surface of the catcher 72. This special arrangement constitutes the turning mechanism 41A.

Figure 4B:
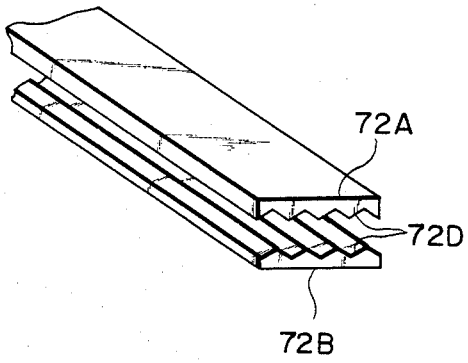
FIG. 4B is a perspective view of the distal end portion of a catcher.

On the opposite faces of the distal end portions of the fixed and swinging catcher members 72A and 72B tape holding portions 72D (FIG. 4B) are formed with a plurality of ridges extending along the extending direction of the catcher 72, that is, at right angles to the tape winding direction. Thus, the thermal adhesive tape MT is prevented from slipping off from the catcher 72 when the catcher 72 holding the tape MT is rotated. When the catcher 72 is moved to the left in FIG. 4A, it can readily be removed from the thermal adhesive tape MT.

A catcher driver 75 is attached to the one side frame 4A. The catcher driver 75 serves to rotate the catcher 72 as the drive shaft 66 rotates. As shown in FIG. 1B, the catcher driver 75 comprises a first gear 75A to rotate together and coaxially with the idle sprocket 17B, a second gear 75B in mesh with the first gear 75A, a third gear 75C to rotate together and coaxially with the second gear 75B, and a fourth gear 75E coaxially fixed to one end of the drive shaft 66. A rotatary force is transmitted from the third gear 75C to the fourth gear 75E by means of a timing belt 75D which is stretched between the third gear 75C and fourth gear 75E. Thus, the catcher driver 75 is driven by the same drive source (motor) 18 with the carrier driver 15. Accordingly, the catcher 72 rotates interlocking with the moving carrier 8.

Namely, the catcher 72 holding the forward end portion of the thermal adhesive tape MT gradually rotates in the counterclockwise direction of FIG. 1B while the carrier 8 moves from the carrier home position CRHP to the carrier stop position CRSP, as shown in FIG. 1B. Thus, the bank notes on the carrier 8 are gradually wound with the thermal adhesive tape MT. Therefore, the radius of gyration of the catcher 72 can be made shorter than the width of the bank notes. According to the prior art mechanism, the thermal adhesive tape must be pulled around a stack of bank notes at a standstill. It is therefore necessary that the radius of gyration of the conventional catcher be longer than the width of the stack of bank notes. In this embodiment, the radius of gyration of the catcher 72 need only be longer than the height of the stack of bank notes, theoretically. By the use of the winder 41 of the aforementioned construction, it is unnecessary to change the radius of gyration of the catcher 72 even if the bank notes vary in width. Thus, the winder 41 can be made compact and improved in applicability to the bank note width. When exporting the bundling apparatus (to be used, for example, as a bank note bundling apparatus), therefore, it is unnecessary to change or readjust the apparatus according to the width of bank notes or bills used in the importing country. For example, a Japanese 10,000-yen note is 84 mm wide; a U.S. dollar is 66 mm wide, a United Kingdom 10-pound note is 85 mm wide, a West German 100-mark note is 80 mm wide, a French 100-franc note is 92 mm wide, an Austrian 1,000-schilling note is 84 mm wide, a Dutch 100-guilder note is 76 mm wide, and an Italian 10,000-lira note is 78 mm wide. The bundling apparatus of the present one embodiment can bundle all these sizes of bank notes without any remodeling.

As described before, the catcher 72 does not rotate relative to the sliding block 71, but revolves as one with the sliding block 71 around the drive shaft 66. Therefore, when the thermal adhesive tape MT held by the catcher 72 is moved around the stack of bank notes, the forward end portion of the thermal adhesive tape MT projecting from the distal end portion of the catcher 72 is turned up so that the coating layer CF with the fusible material faces inside. Thus, a turnup portion BP is formed on the forward end portion of the thermal adhesive tape MT. The coating layer CF of the turnup portion BP is opposed to the coating layer CF of the thermal adhesive tape MT. Even through the turnup portion BP is heated, therefore, the fusible material will never stick to the bank notes. Thus, the heat bonding mechanism 43 heats that portion of the thermal adhesive tape MT which is joined with the turnup portion BP.

The respective motions of the carrier 8 and the catcher 72, in particular, are physically interlocked by mechanical means. Accordingly, it is possible to completely prevent timing errors attributed to electrical noise or interference between the movement of the catcher 72 and the rotation of the carrier 8. Referring now to FIG. 1B, the interlocking timing of the catcher 72 and the carrier 8 will be described. When the carrier 8 is in the carrier home position CRHP, the catcher 72 is located in a catcher home position CTHP indicated by a solid line in FIG. 1B. At this time, the engaging roller 22 attached to the chain 20 is located in a roller home position RHP indicated by a solid line in FIG. 1B. When the carrier 8 reaches the carrier stop position CRSP, the engaging roller 22 is brought to a roller separation position RTOP indicated by a two-dots and dash line on the idle sprocket 17B. At this time, the catcher 72 is located in a catcher intermediate position CTIP over the stack of bank notes, as indicated by a one dot and dash line in FIG. 1B. When the engaging roller 22 reaches a first reverse position 1st RP beyond the roller separation position RTOP, the catcher 72 passes through the catcher home position CTHP to reach a catcher seal position CTSP indicated by a two-dots and dash line in FIG. 1B.

When the engaging roller 22 moves between the roller separation position RTOP and the first reverse position 1st RP, it is disengaged from the transmission member 24. Accordingly, the carrier 8 does not move, and only the catcher 72 rotates. The motor 18 is rotated in the reverse direction to move the engaging roller 22 to a second reverse position 2nd RP behind the roller home position RHP. Then, the motor 18 is rotated again in the forward direction to move the engaging roller 22 to the roller home position RHP. Thus, the carrier 8 is returned to the carrier home position CRHP. When the catcher 72 is in the catcher home position CTRP as indicated by a two-dots and dash line in FIG. 5, the sliding block 71 assumes a first stop position 1st SP. When the catcher 72 is in the catcher seal position CTSP, the sliding block 71 takes a second stop position 2nd SP as indicated by a solid line in FIG. 5.

Figure 6:
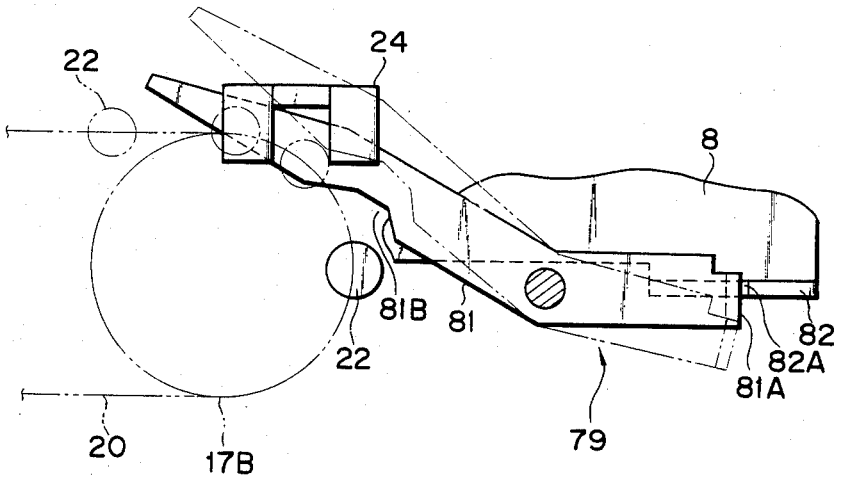
FIG. 6 is a front view of a retaining lever mechanism.

To secure such interlocking timing, a carrier retaining mechanism is provided which holds the carrier 8 when the engaging roller 22 moves between the roller separation position RTOP and the first reverse position 1st RP to rotate only the catcher 72. As shown in FIG. 1B, the carrier retaining mechanism is provided with a magnet block 78 which magnetically attracts and holds the carrier 8 in the carrier stop position CRSP. As shown in FIGS. 2 and 6, the carrier retaining mechanism further includes a retaining lever mechanism 79 disposed near the idle sprocket 17B. The retaining lever mechanism 79 has a stud 80 attached to the inner surface of the one side frame 4A. A retaining lever 81 is swingably attached to the stud 80 so as to be able to engage the engaging roller 22 moving together with the chain 20. The retaining lever 81 is urged in the counterclockwise direction of FIG. 6 by an urging member (not shown), and kept inclined, as indicated by a solid line in FIG. 6. A bent hook portion 81A is formed at the right end portion (FIGS. 2 and 6) of the retaining lever 81. When the carrier 8 is moved to the carrier stop position CRSP, the hook portion 81A slips into a groove 82A of a stopper 82 attached to the lateral portion of the carrier 8. As the engaging roller 22 moving with the chain 20 engages the left end portion of the retaining lever 81, the regaining lever 81 is gradually swung clockwise (FIG. 6) against the urging force of the urging member (not shown). Immediately after the carrier 8 reaches the carrier stop position CRSP to cause the engaging roller 22 to be disengaged from the transmission member 24, the engaging roller 22 reaches a cut portion 81B at the middle portion of the retaining lever 81. Accordingly, the retaining lever 81 is swung counterclockwise (FIG. 6) by the urging force of the urging member, so that the hook portion 81A is fitted in the stopper 82 of the carrier 8 to position the carrier 8 in place. This carrier retaining mechanism prevents the carrier 8 from being dislocated even if the thermal adhesive tape MT is tightened after it is wound around the stack of bank notes. Thus, the timing of the interlocking between the carrier 8 and the catcher 72 can be maintained with high reliability.

Figure 7:
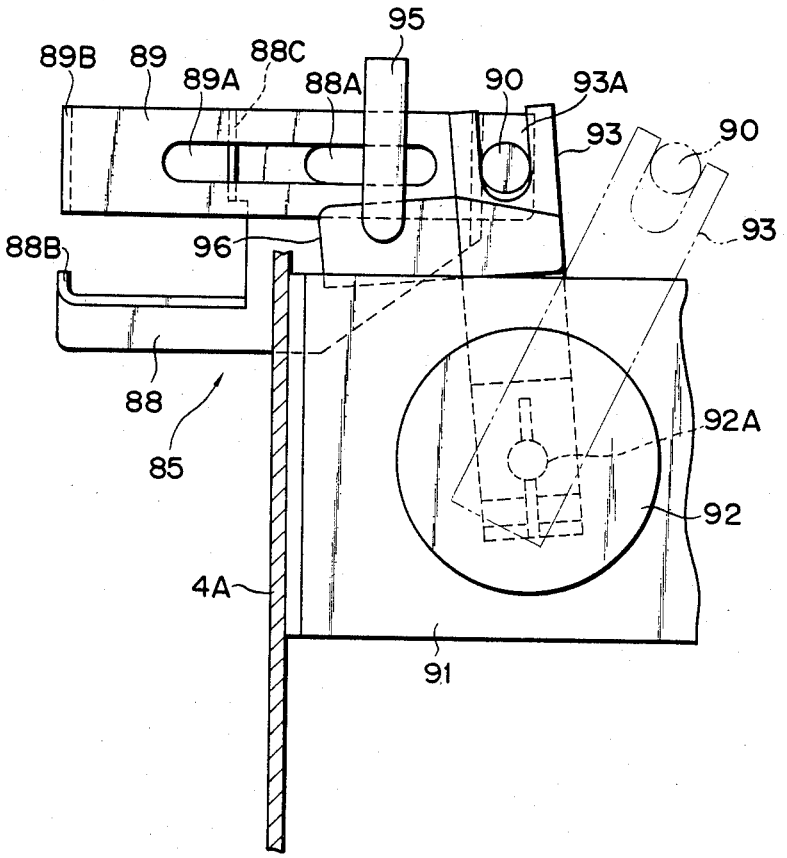
FIG. 7 is a left side view of an open/pull drive mechanism.

The catcher 72 is opened to receive the thermal adhesive tape MT in the catcher home position CTHP. When in the catcher seal position CTSP, the catcher 72 is pulled downward as in FIG. 2 (or to the left in FIG. 4) to be disengaged from the bundle. To perform these actions of the catcher 72, an open/pull driver 85 is attached to the one side frame 4A, as shown in FIG. 2. FIG. 5 shows the back of the open/pull driver 85, and FIG. 7 is a left side view showing part of the open/pull driver 85.

As shown in FIG. 2, the open/pull driver 85 has a lever holder 86 which is L-shaped in plane configuration and attached to the one side frame 4A. Two guide rollers 87 (only one is shown in FIG. 2) are arranged side by side on the lever holder 86 at right angles to the feeding direction of the bank notes. An open lever 88 having a slot 88A and a pull lever 89 having a slot 89A are reciprocatively supported by the guide rollers 87 so that the guide rollers 87 are fitted in the slots 88A and 89A. At one end portion of the pull lever 89 a pull lever hook portion 89B is formed which can engage the hook lever 73 attached to the sliding block 71. As the hook portion 89B engaging the hook lever 73 is pulled to the right in FIG. 7, therefore, the sliding block 71 is pulled in a like manner, and the catcher 72 is disengaged from the thermal adhesive tape MT. A guide roller 90 is rotatably attached to the other end portion of the pull lever 89. At one end portion of the open lever 88 an open lever hook portion 88B is formed which can engage the hook portion 72C formed on the swinging catcher member 72B. As the hook portion 88B engaging the hook portion 82C is pulled to the right of FIG. 7, therefore, the swinging catcher member 72B is swung in a clockwise direction in FIG. 4A, so that the catcher 72 is opened. An abutting portion 88C to abut against the pull lever hook portion 89B is formed at the middle portion of the open lever 88.

A rotary solenoid 92 is attached to the one side frame 4A by means of a solenoid holder 91. One end portion of a rocking lever 93 is fixed to a solenoid shaft 92A of the rotary solenoid 92. At the other end portion of the rocking lever 93 a cut portion 93A is formed which engages the guide roller 90 attached to the other end portion of the pull lever 89. Thus, the pull lever 89 reciprocates as the rocking lever 93 rocks, and the open lever 88 moves when the pull lever hook portion 89B abuts against the abutting portion 88C of the open lever 88. The open lever 88 is urged to the left of FIG. 7 by an urging member (not shown). As shown in FIG. 5, the open lever 88 and the pull lever 89 are arranged at a given angle to each other.

When the catcher 72 is in the catcher home position CTHP, as indicated by a two-dots and dash line in FIG. 5, the hook portion 72C of the catcher 72 is located in such a position that it can engage the open lever hook portion 88B. If the rotary solenoid 92 is then actuated, only the opening of the catcher 72 can be achieved. In any other position than the catcher home position CTHP, the catcher 72 is closed. When the catcher 72 is in the catcher seal position CTSP, as indicated by a solid line in FIG. 5, the hook lever 73 attached to the sliding block 71 is located in the position to engage the pull lever hook portion 89B. If the rotary solenoid 92 is then actuated, the sliding block 71 can be moved along the drive shaft 66.

As shown in FIGS. 2 and 7, a sensor, e.g. a photosensor 95, for checking the operation of the open/pull driver 85 is provided at the middle portion of the lever holder 86. A detected plate 96 to be detected by the sensor 95 is attached to the rocking lever 93. When the abutting portion 88C of the open lever 88 moves in contact with the pull lever hook portion 89B of the pull lever 89, the extreme end of the detected plate 96 is disengaged from the sensor 95. In this manner, the sensor 95 checks the open/pull driver 85 for operation. With this arrangement, the single rotary solenoid 92 can serve both to insert the thermal adhesive tape MT in the catcher 72 and to disengage the catcher 72 from the bundle. Moreover, the operation check can be achieved by the use of the single sensor 95.

The main clamp mechanism 42 is constructed as shown in FIGS. 1B and 2. One end portion of a horizontally extending clamp bracket 100 is attached to the right end portion (FIG. 2) of the one side frame 4A. Two vertically extending guide plates 101 arranged parallel to each other with a prop 102 between them are fixed to the other end portion of the clamp bracket 100. The guide plates 101 have their respective guide slots 101A extending along their longitudinal direction. A pair of clamp levers 104, each having two guide rollers 103 at one end portion to be fitted in the guide slot 101A of each guide plate 101, extend to the left in FIG. 2 so that the two guide plates 101 are sandwiched between the clamp levers 104. Thus, the clamp levers 104 can move along their corresponding guide slots 101A. The two clamp levers 104 are coupled by means of a shaft 105 and thus can move as a body. The clamp levers 104 are arranged in such positions that they do not come into contact with either the thermal adhesive tape MT wound around the stack of bank notes on the carrier 8 or with the clamp plate 33.

A clamp lever driver 106 is provided for moving the clamp levers 104. The clamp lever driver 106 comprises a bearing 107 at the intermediate portion of the clamp bracket 100, a drive shaft 108 rockably supported by the bearing 107, a cam lever 109 fixed to one end of the drive shaft 108 and having a cut portion 109A to engage the shaft 105, a cam follower lever 110 fixed to the other end of the drive shaft 108 and having a cam follower 110A, a clamp motor 111 having a cam 111A to engage the cam follower 110A, and an urging member (not shown) to bring the cam follower 110A into close contact with the outer peripheral surface of the cam 111A. Thus constructed, the clamp lever driver 106 can reciprocate the clamp levers 104 along the guide slots 101A by means of the cam lever 109 which rocks as the cam 111A rotates.

Figure 11A:
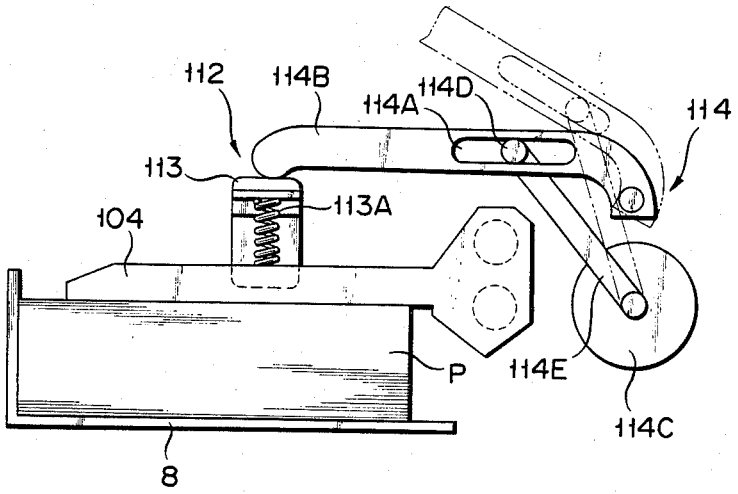
FIGS 11A and 11B are schematic front and side views of a pressing device, respectively.
Figure 11B:
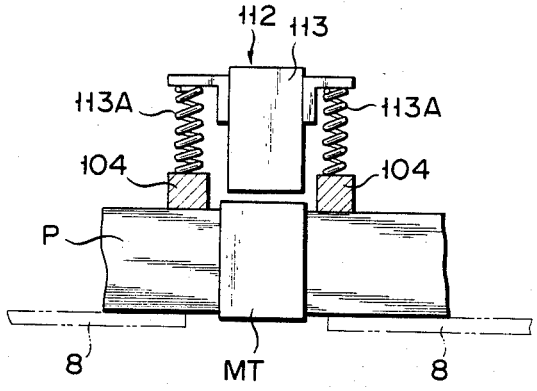

As shown in FIGS. 11A and 11B, a data-stamping mechanism 112 is disposed between the clamp levers 104. The mechanism 112 comprises a stamp 113 bearing specified data to be stamped on the thermal adhesive tape MT and a stamp drive mechanism 114 for activating the stamp 113. The stamp 113 is coupled to both clamp levers 104 by compression springs 113A and 113B. The stamp drive mechanism 114 activates the stamp 113 at any time while the end portions of the tape MT wound around the stack of sheets P are being bonded by the heat bonding mechanism 43 which will be described later.

More specifically, as shown in FIG. 11A, the stamp drive mechanism 114 is disposed near the clamp levers 104 so as to push down the stamp 113. The mechanism 114 comprises a pushing lever 114A, a rotary solenoid 114C and a drive lever 114E. The pushing lever 114B has an elongated hole 114A in its intermediate portion and has one end pivotally supported. The drive lever 114E has one end fixed to the shaft of the rotary solenoid 114C and the other end coupled to a guide roller 114D which is fitted in the elongated hole 114A. When the rotary solenoid 114C rotates counterclockwise in FIG. 11A and the drive lever 114E thus swings counterclockwise, the pushing lever 114B is rocked counterclockwise, too. As a result, the free end of the pushing lever 114B pushes down the stamp 113, whereby the specified data are stamped on the thermal adhesive tape MT.

This data-stamping is performed at any time between the tightening of the tape MT by the feeder 40 and the thermal bonding of the end portions of the tape MT by a heater block 121 (to be described later). In other words, the data can be stamped during an idle period of the bundling apparatus. This enhances the efficiency of a bundling operation which includes the data-stamping.

The heat bonding mechanism 43 is constructed as shown in FIGS. 1B and 2. A heat bonding bracket 115 is attached to the other side frame 4B. A guide base 117 is attached to the heat bonding bracket 115 by means of a block 116, extending parallel to the side frame 4B. The guide base 117 is fitted with two pairs of guide rollers 118 arranged along the tape feeding direction and facing one another. A slide base 119 is held between the guide rollers 118 for reciprocation. A heater block 121 is mounted on the slide base 119 by means of a holder 120. The heater block 121 is rockably attached to the holder 120. The heater block 121 is urged in the clockwise direction of FIG. 1B by an urging member (not shown), and is kept by a stopper (not shown) in the position indicated by a solid line in FIG. 1B. When the slide base 119 moves upward (FIG. 1B), the heater block 121 abuts against that portion of the thermal adhesive tape MT around the stack of bank notes on the carrier 8 which is joined with the turnup portion BP. Thereafter, the heater block 121 rocks counterclockwise (FIG. 1B) against the urging force of the urging member to assume the position indicated by a two-dots and dash line in FIG. 1B.

A heater block drive mechanism 128 is formed of a guide roller 122 mounted on the intermediate portion of the slide base 119, a rocking lever 123 having, at one end portion, a cut portion to engage the guide roller 122 and, rockably mounted on the heat bonding bracket 115 at the other end portion, a crank lever 124 having a slider 124A to engage a slot in the middle portion of the rocking lever 123, and a drive motor 125 for rotating the crack lever 124. Thus, the heater block 121 is reciprocated by actuating the drive motor 125.

As shown in FIG. 1B, a tape stopper 126 formed of, e.g., a leaf spring, is rockably disposed between the two guide plates 101. A nonskid rubber plate 127 is attached to the upper surface of the tape stopper 126. The tape stopper 126 rocks as the heater block 121 moves. Namely, the tape stopper 126 presses the thermal adhesive tape MT against the stack of bank notes P before the heat bonding operation by the heater block 121, thereby preventing the tape MT from slackening when cut by the cutting edges 53A and 53B of the feeder 40.

Referring mainly to FIGS. 8A to 8F, the operation of the bundling apparatus of the aforementioned construction will now be described.

Figure 8A:
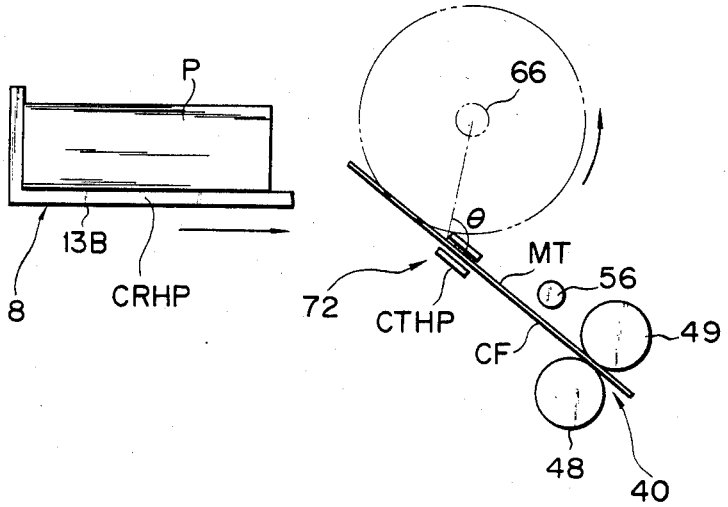
FIGS. 8A to 8F are front views illustrating the steps in a bundling operation.

When the carrier 8 is in the carrier home position CRHP, as shown in FIG. 8A, the backup plate 3 is lowered so that the stack of bank notes P on the backup plate 3 is transferred to the beds 13A to 13C of the carrier 8. At this time, the catcher 72 is in the catcher home position CTHP. Namely, the hook portion 72C of the catcher 72 is in the position where it engages the open lever hook portion 88B. Accordingly, the catcher 72 is opened (i.e., the fixed and swinging catcher members 72A and 72B, respectively, are separated as shown in FIG. 8A) when the rotary solenoid 92 is actuated. Then, the thermal adhesive tape MT is inserted between the fixed and swinging catcher members 72A and 72B by the feeder 40. Thereafter, the rotary solenoid 92 is demagnetized to cause the thermal adhesive tape MT to be held by the catcher 72.

Figure 8B:
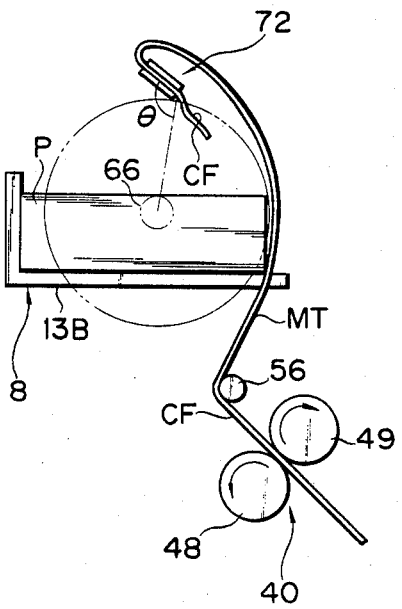
Figure 8C:
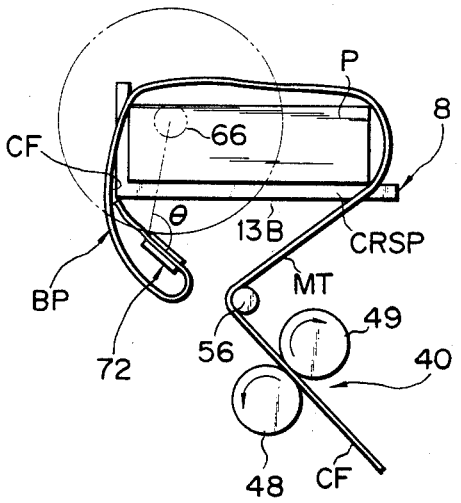
Figure 8D:
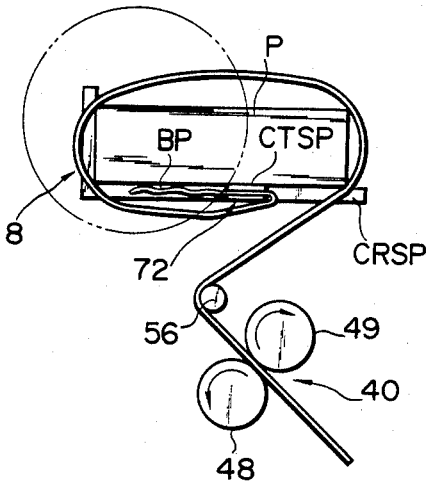

After this is done, the motor 18 is driven in the clockwise direction of FIG. 1B to move the carrier 8 and the catcher 72 altogether in an interlocked manner. At this time, the carrier 8 and the catcher 72 move as shown in FIGS. 8B and 8C. Thus, as the carrier 8 moves, the catcher 72 rotates counterclockwise to wind the thermal adhesive tape MT gradually around the stack of bank notes P. Since the carrier 8 and the catcher 72 are interlocked, the radius of gyration of the catcher 72 can be shorter than the width of the stack of bank notes P along the transfer direction thereof. As a result, the winder 41 can be made compact, and improved in applicability to the width of the bank notes P. The turnup portion BP with the coating layer CF inward is formed at the forward end portion of the thermal adhesive tape MT by revolving the catcher 72 around the drive shaft 66 while maintaining the fixed angle $\theta$ between the catcher 72 and the drive shaft 66. Accordingly, the fusible material on the thermal adhesive tape MT will never stick to the bank notes P even though the tape MT is joined with the turnup portion BP for thermal welding. The stack of bank notes P is wound with the thermal adhesive tape MT on the carrier 8 by the use of the space between the first and second beds 13A and 13B. It is therefore possible to avoid a delivery action of bank notes which may cause the dislocation or collapse of the stack of bank notes P. The auxiliary clamp mechanism 29 rocks in the clockwise direction in FIG. 2 before the carrier 8 reaches the carrier stop position CRSP shown in FIG. 8C. Thus, the bank notes P on the carrier 8 are pushed and aligned by the aligning rod 36 of the auxiliary clamp mechanism 29. The aligned bank notes P are retained by the bottom surface of the clamp plate 33. Therefore, the dislocation and collapse of the stack of bank notes P can be prevented even though the tape winding is executed during the transfer of the stack of bank notes P.

Figure 8E:
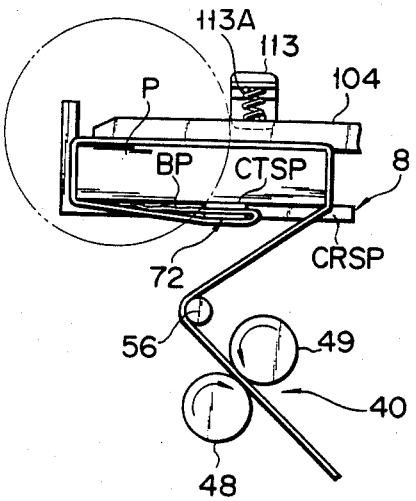

When the carrier 8 reaches the carrier stop position CRSP, the engaging roller 22 moving with the chain 20 is disengaged from the transmission member 24 attached to the carrier 8, as shown in FIG. 6. At this time, the retaining lever 81 of the retaining lever mechanism 79 is actuated by the engaging roller 22 to be fitted in the groove 82A of the stopper 82 of the carrier 8. Thus, the carrier 8 is retained in the carrier stop position CRSP. The chain 20 is then driven continuously to rotate the catcher 72 up to the catcher seal position CTSP shown in FIG. 8D. Thereupon, the clamp levers 104 of the main clamp mechanism 42 are lowered to compressively hold the stack of bank notes P on the carrier 8, as shown in FIG. 8E. Since the auxiliary clamp mechanism 29 also presses on the stack of bank notes P when the main clamp mechanism 42 operates, the stack of bank notes P is doubly clamped by the main and auxiliary clamp mechanisms 42 and 29. Accordingly, the stack of bank notes P will not be left unclamped before it is clamped by the main clamp mechanism 42. Thus, the stack of bank notes P can be securely retained. In this state, the feeder 40 pulls back the thermal adhesive tape MT for tightening, thereby bringing the tape MT into close contact with the stack of bank notes P. As shown in FIGS. 8A to 8E, the supply direction and return direction of the thermal adhesive tape MT are different. The thermal adhesive tape MT, however, is guided by the guide roller 56. Therefore, it is unnecessary to provide a mechanism for changing the position of the feeder 40 according to the shift between the supply and return directions of the thermal adhesive tape MT.

Figure 8F:
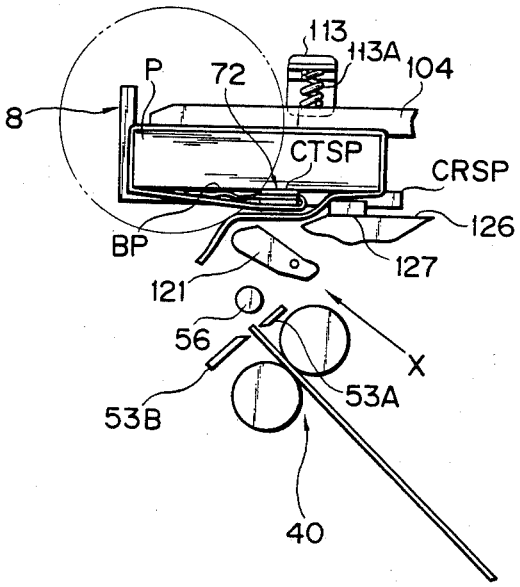

Thereafter, the heater block 121 of the heat bonding mechanism 43 is moved in the direction of arrow X of FIG. 8F. As the heater block 121 moves, the tape stopper 126 rocks clockwise, so that the rubber plate 127 on the tape stopper 126 presses the thermal adhesive tape MT against the stack of bank notes P to retain the bank notes. Thereafter, the thermal adhesive tape MT is cut by the cutting edges 53A and 53B of the feeder 40. Then, the heater block 121 moving in the direction of arrow X heats the cut end portion of the thermal adhesive tape MT while joining it to the turnup portion BP. Since only that portion of the thermal adhesive tape MT which is joined with the turnup portion BP is heated, the turnup portion BP and the cut end of the tape MT can be welded together with the aid of the fusible material between them without causing the fusible material to stick to the stack of bank notes P. Accordingly, it is unnecessary to use the heater pad which is conventionally inserted between the stack of bank notes and the heated portion of the thermal adhesive tape when they are welded without forming the turnup portion. Thus, there is no fear of the thermal adhesive tape MT sticking to the heater pad.

As described above, while the heater block 212 is carrying out the thermal welding, the rotary solenoid 114C is activated, thereby rotating the pushing lever 114B counterclockwise in FIG. 11A. The stamp 113 is therefore pushed down and stamps the data on the thermal adhesive tape MT during the thermal welding.

After the thermal welding, the carrier 8, along with the bundle, is moved to the carrier back position CRBP, so that the catcher 72 is disengaged from the bundle. When the catcher 72 is in the catcher seal position CTSP, the hook lever 73 of the sliding block 71 is so located as to engage the pull lever hook portion 89B of the pull lever 89 of the open/pull driver 85, as shown in FIG. 5. When the rotary solenoid 92 is actuated, therefore, the pull lever 89 is moved downward (FIG. 2), so that the catcher 72 is disengaged from the bundle. When the main clamp mechanism 42 is returned to the position shown in FIG. 1B, the carrier 8 is moved in the reverse direction. In the middle of the transfer of the carrier 8, the auxiliary clamp mechanism 29 is returned to the position indicated by the solid line in FIG. 2. When the carrier 8 passes by the scraper 26 nested therewith, only the bundle on the carrier 8 abuts against the scraper 26 to be restrained thereby from moving, and is dropped into the chute 72 below. Then, the carrier 8 is moved again in the forward direction from the carrier back position CRBP to the carrier home position CRHP. Thus, one cycle of operation is completed.

In the aforementioned embodiment, the objects to be bundled are described as bank notes. However, the apparatus of the present invention may be applied to packages in a pile and to any other suitable objects or materials.

Figure 9:
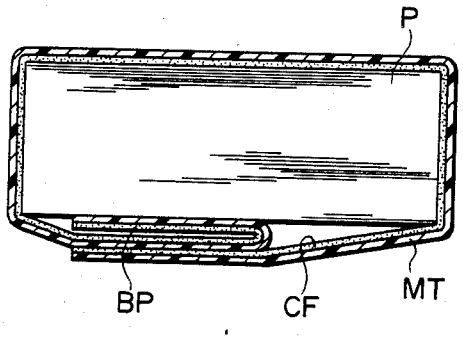
FIG. 9 is a sectional view of a stack of objects bundled by the bundling apparatus.
Figure 10:
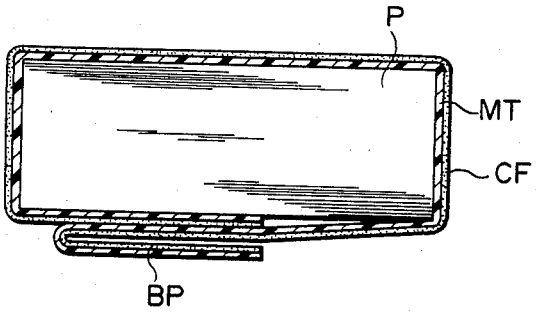
FIG. 10 is a sectional view of another stack of objects bundled with a band.

The manner of turning up the band material by the winder is not limited to the one illustrated in FIG. 9. As shown as a modification in FIG. 10, for example, the thermal adhesive tape MT may be wound around the stack of bank notes P with the coating layer CF outward so that the turnup portion BP is formed at the cut end portion of the tape MT.

Although the auxiliary clamp mechanism 29 also serves as aligning means in the foregoing embodiment, the bank notes may be aligned by any other suitable means. In lowering the backup plate 3 of FIG. 1 to transfer the stack of bank notes thereon to the carrier 8, the backup plate 3 may first be lowered from the upper position $A_0$ to the position $A_1$ of FIG. 1. Then, the carrier 8 is moved to the right of FIG. 1 to bring the back plates 13*a*, 13*b* and 13*c* of the carrier 8 into contact with the stack of bank notes on the backup plate 3, thereby aligning or truing up the bank notes. Immediately after this, the backup plate 3 is lowered to the lower position $A_2$ to transfer the stack of sheets entirely to the carrier 8.

In the aforementioned embodiment, moreover, the motion of the carrier and the catcher are physically interlocked by their mechanical arrangement. Alternatively, however, an independent drive mechanism may be provided so that the carrier and the catcher are operated synchronously under electronic control.

It is to be understood that the above description is for purposes of illustration only, and that the individual members of the apparatus may be replaced with any other suitable members with the same functions.

In the bundling apparatus of the present invention, as described above, one end portion of a band material coated on one side with a thermally fusible material is turned up so that the band material may be thermally bonded at the turnup portion. Thus, the heater pad, which is essential to the prior art apparatus, is obviated in the present invention, and the objects to be bundled can be bundled with a higher reliability.

As described above in detail, the present invention provides a bundling apparatus which comprises clamping means for pressing and holding a stack of objects and a data-stamping means attached to the clamping means, said data-stamping means being actuated to stamp data on a band wound around the stack while the end portions of the band are being bonded together.

What we claim is:

1. A bundling apparatus which comprises:

first clamping means for pressing a stack of objects in the direction of thickness of the stack and holding the stack;

band-winding means for winding a band around the stack of objects held by the first clamping means;

bonding means for bonding end portions of the band to each other, said end portions being positioned on one side of said stack; and data-stamping means for stamping specified data on the band wound around the stack, said data-stamping means including (a) a stamp bearing the specified data, and (b) first drive means for bringing the stamp into contact with a portion of the band positioned on another side of said stack opposite to said one side while the end portions of the band are being bonded to each other by said bonding means.

2. The bundling apparatus according to claim 1, wherein said first clamping means includes clamp levers which come into contact with the uppermost object of said stack and push the stack in the direction of thickness of the stack, and said stamp is resiliently coupled to the clamp levers and positioned to contact the band wound around the stack.

3. The bundling apparatus according to claim 2, wherein said first drive means includes a rotary solenoid to be activated while said bonding means is bonding the end portions of the band, and a pushing lever for bringing said stamp into contact with the band when the rotary solenoid is activated.

4. The bundling apparatus according to claim 1, which further comprises conveyor means for conveying the stack of objects to said band-winding means along a specific conveying path.

5. The bundling apparatus according to claim 4 wherein said conveyor means includes a carriage on which the stack of objects is to be mounted and which is movable between a first position at which the stack of objects is mounted onto the carriage and a second position which is within said band-winding means, and second drive means for moving the carriage from the first position to the second position after the stack of objects is mounted onto the carriage and then from the second position to the first position after said bonding means bonds the end portions of the band.

6. The bundling apparatus according to claim 5, which further comprises second clamping means located above said carriage for pressing the stack of objects on the carriage in the direction of thickness of the stack and holding the stack thereon while the carriage is moving from the first position to the second position and for releasing the stack of objects when the carriage starts moving from the second position to the first position.

7. The bundling apparatus according to claim 6, wherein said second clamping means includes a lever to come into contact with the uppermost object of the stack mounted on said carriage to thereby press the stack in the direction of thickness thereof and a cam member having a first cam surface to contact one end of the second clamp lever thereby to push the second clamp lever away from the stack when said carrier is at the first position and a second cam surface to push the second clamp lever into contact with the stack when said carriage is outside the first position.

8. The bundling apparatus according to claim 7, further comprising band-feeding means for feeding the band to said band-winding means.

9. The bundling apparatus according to claim 8, wherein said band-feeding means includes a pair of feed rollers rotatable in one direction to feed the band to the stack of objects and in the opposite direction to pull the band away from the stack, a guide roller positioned between said band-winding means and the stack of objects, and cutting means positioned between the guide roller on one hand and the feed rollers on the other for cutting the band fed from said band-feeding means.

* * * * *